US012799652B2

(12) United States Patent
Scappocin et al.

(10) Patent No.: US 12,799,652 B2
(45) Date of Patent: Nov. 17, 2026

(54) FRAME FOR CLAMPING FABRIC FOR EMBROIDERY MACHINES AND EMBROIDERY MACHINE COMPRISING SAID FRAME

(71) Applicant: Moncler S.P.A., Milan (IT)

(72) Inventors: Barbara Scappocin, Campodarsego (IT); Roberto Arsanto, Turin (IT)

(73) Assignee: Moncler S.P.A., Milan (IT)

( * ) Notice: Subject to any disclaimer, the term of this patent is extended or adjusted under 35 U.S.C. 154(b) by 344 days.

(21) Appl. No.: 18/281,301

(22) PCT Filed: Feb. 8, 2022

(86) PCT No.: PCT/EP2022/053027
§ 371 (c)(1),
(2) Date: Sep. 10, 2023

(87) PCT Pub. No.: WO2022/189084
PCT Pub. Date: Sep. 15, 2022

(65) Prior Publication Data

US 2024/0150948 A1 May 9, 2024

(30) Foreign Application Priority Data

Mar. 11, 2021 (IT) ..... 102021000005705

(51) Int. Cl.
*D05C 9/04* (2006.01)

(52) U.S. Cl.
CPC ..... *D05C 9/04* (2013.01); *D05D 2303/20* (2013.01)

(58) Field of Classification Search
CPC ..... D05C 9/04; D05B 3/20; D05B 39/00
USPC ..... 112/102.5, 103
See application file for complete search history.

(56) References Cited

U.S. PATENT DOCUMENTS

| | | | | |
|---|---|---|---|---|
| 4,681,048 | A | 7/1987 | Willenbacher | |
| 4,682,556 | A | 7/1987 | Block | |
| 5,261,340 | A * | 11/1993 | Conley, Jr. | D05B 39/00 112/470.14 |
| 5,454,337 | A | 10/1995 | Frye | |
| 6,298,800 | B1 * | 10/2001 | Gala | D05C 9/04 112/103 |

FOREIGN PATENT DOCUMENTS

| | | | | |
|---|---|---|---|---|
| JP | S5066852 | | 6/1975 | |
| JP | S5066852 | U | 6/1975 | |
| JP | S5995985 | U | 4/1987 | |
| KR | 20110007253 | U * | 7/2011 | D05C 9/04 |

OTHER PUBLICATIONS

Office Action issued on Jun. 29, 2025, in corresponding Chinese Application No. 202280019995.9, 15 pages.
Office Action issued on Jun. 14, 2026, in corresponding Chinese Application No. 202280019995.9, 12 pages.

* cited by examiner

*Primary Examiner* — Nathan E Durham
(74) *Attorney, Agent, or Firm* — Maier & Maier, PLLC

(57) ABSTRACT

A frame for clamping fabric for embroidery machines, comprising a template for sewing labels. The template can move transversely with respect to a resting surface of a fabric and comprises at least one cutout plate, which has at least one opening the shape of which matches a first label to be applied by sewing to the fabric, the inner rim of the opening being adapted to contain laterally the first label during sewing.

8 Claims, 7 Drawing Sheets

FRAME FOR CLAMPING FABRIC FOR EMBROIDERY MACHINES AND EMBROIDERY MACHINE COMPRISING SAID FRAME

CROSS-REFERENCE TO RELATED APPLICATIONS

The disclosures in Italian Patent Application No. 102021000005705 from which this application claims priority are incorporated herein by reference.

SUMMARY

The present invention relates to a frame for clamping fabric for embroidery machines and to an embroidery machine comprising said frame. The invention also relates to a method for sewing labels with said embroidery machine.

An embroidery machine comprises typically a fixed sewing head, provided with one or more needles crossed by a thread and movable with reciprocating motion in a substantially vertical direction. Furthermore, the embroidery machine also comprises typically a fabric clamping frame, which is detachably supported by a mechanism with carriages that are movable in two respective orthogonal directions X and Y, which define a geometric plane X-Y substantially at right angles to the direction of motion of the sewing needle. Said geometric plane coincides with, or is substantially parallel to, the surface for resting the fabric to be embroidered. In this manner, by combining the movements of the carriages in the plane X-Y, the fabric retained by the clamping frame can be moved parallel to said resting surface according to a plurality of positions so that the needle can provide a sewing line according to a plurality of predefined patterns, obtained on the basis of at least one embroidery program stored in the control system integrated in or associated with the embroidery machine.

One drawback of known embroidery machines is observed when they are used to fix a label, also known as patch, to a fabric. To perform fixing, the sewing line provided by the embroidery machine substantially follows the perimeter of the label, so that the entire perimeter of the label is sewn to the fabric.

With an embroidery program for sewing according to a pattern which substantially matches the external shape of the label to be applied, it is complicated for an operator to correctly orient the label relative to the sewing head so that the sewing line generated by means of the embroidery program for that label is correctly aligned along the entire edge of the label. An incorrect alignment can lead to uneven edge work on the label and to visible defects in the sewing line. The operator must also hold the label steady with his hand during at least part of the sewing onto the fabric.

A further drawback arises when multiple labels, even of different shapes, have to be fixed to the fabric. In this case the operator may also have difficulty in positioning the labels correctly relative to each other on the same fabric.

The aim of the present invention is to provide a frame for clamping fabric and a corresponding embroidery machine, as well as a corresponding method, which are capable of improving the background art in one or more of the aspects mentioned above.

Within the scope of this aim, an object of the invention is to be able to provide correct sewing along the perimeter of a label to be fixed to a fabric.

Another object of the invention is to avoid holding the label manually during sewing.

A further object of the invention is to facilitate the application of a plurality of labels, optionally mutually different ones, to a same fabric or to different portions of a same item of clothing.

Another object of the invention is to devise a frame for clamping fabric and a corresponding embroidery machine, as well as a corresponding method, for applying labels which can be used at the industrial level, i.e., for mass productions of fabrics or items of clothing with sewn-on labels of the patch type.

Moreover, an object of the present invention is to overcome the drawbacks of the background art in a manner that is alternative to any existing solutions.

Not least object of the invention is to provide a frame for clamping fabric and a corresponding embroidery machine, as well as a corresponding method, which are highly reliable, relatively easy to provide and at competitive costs.

This aim and these and other objects which will become better apparent hereinafter are achieved by a frame for clamping fabric for embroidery machines characterized in that it comprises a template for sewing labels, said template being movable transversely with respect to a resting surface for the fabric and comprising at least one cutout plate, said plate comprising at least one opening the shape of which matches a first label to be applied by sewing to the fabric, the rim of said at least one opening being adapted to contain laterally said first label during sewing. Such frame can be optionally provided with one or more of the characteristics of the dependent claims.

This aim and these and other objects of the invention are also achieved by an embroidery machine comprising such clamping frame and by a method for sewing labels with such an embroidery machine, characterized in that the method comprises the steps of:

- lifting the clamping frame in order to interpose a fabric between said frame and the resting surface;
- lowering the clamping frame onto the resting surface in order to retain the fabric in a direction perpendicular to the resting surface;
- inserting at least the first label in said at least one opening of the cutout plate of the clamping frame, so that a form fitting occurs between the first label and said opening;
- applying said at least one first sewing line along the peripheral region of said first label by means of the actuation of at least one needle of the sewing head and of the simultaneous movement of said clamping frame with respect to said sewing head according to said embroidery program. Optionally such method can comprise one or more of the characteristics of the dependent claims.

BRIEF DESCRIPTION OF THE FIGURES

Further characteristics and advantages of the invention will become better apparent from the description of a preferred but not exclusive embodiment of the invention, illustrated by way of non-limiting example in the accompanying drawings, wherein.

DETAILED DESCRIPTION OF EMBODIMENTS

Figure 1:
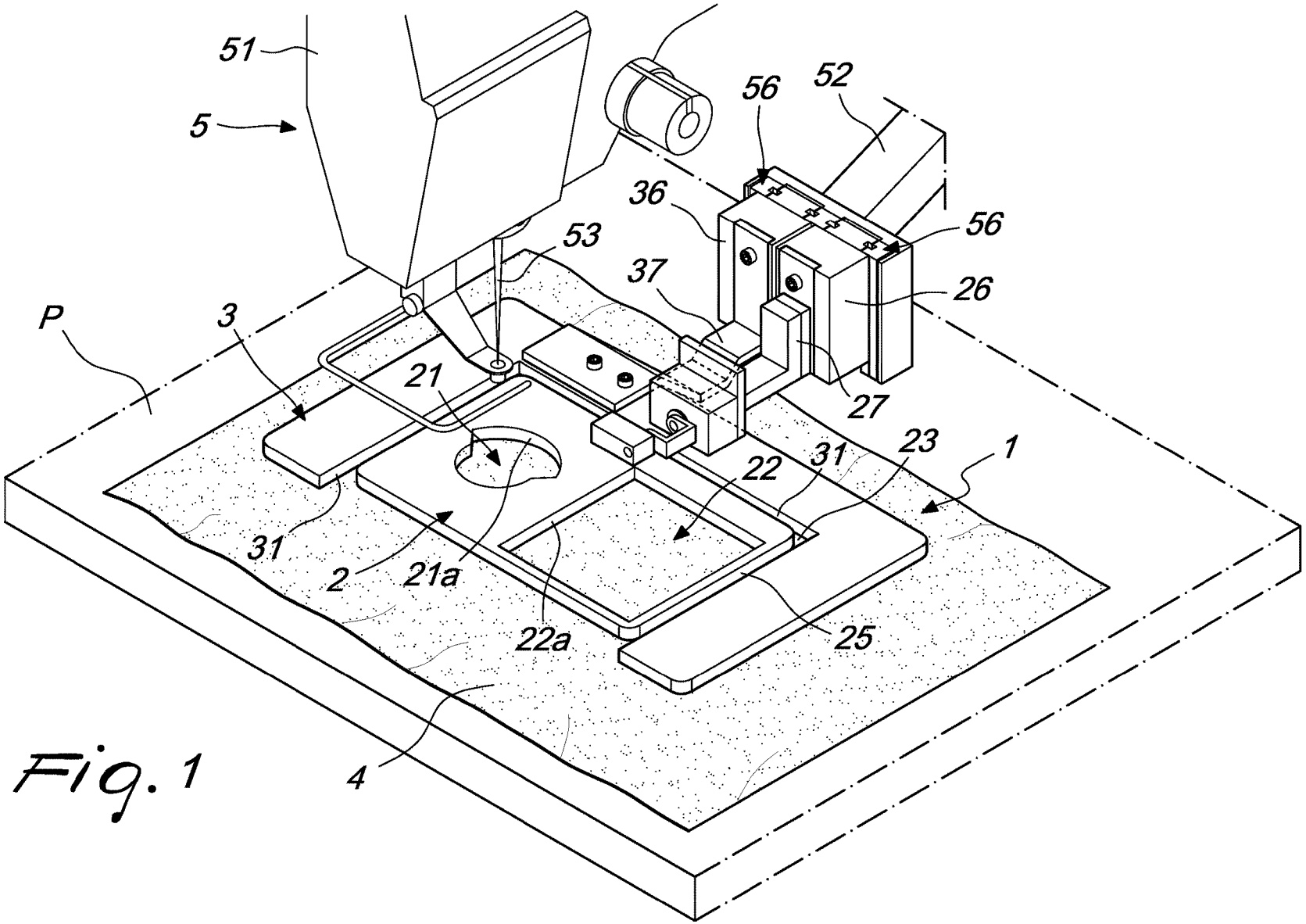
FIG. 1 is a view of a detail of an embroidery machine according to the invention, with the clamping frame raised to receive the fabric.

With reference to the cited figures, a frame for clamping fabric for embroidery machines according to the invention, generally designated by the reference numeral 1, comprises a template 2, 3 for sewing labels, which can move transversely with reference to a resting surface P for a fabric 4 between a raised position for insertion/removal of the fabric 4 in/from the embroidery machine and a lowered position for clamping the fabric 4 on the resting surface P.

The clamping frame 1 is mounted, preferably in a detachable manner, on movement means of an embroidery machine 5, which is shown only partially in the figures. The movement means can comprise an arm 52 of a (per se known) mechanism with carriages which can move in two respective mutually orthogonal directions X and Y, which define a geometric plane X-Y that is substantially perpendicular to the direction of the motion of the sewing needle 53 of the sewing head 51 of the embroidery machine 5. Said geometric plane X-Y coincides with, or is substantially parallel to, the resting surface P of the fabric 4.

The movement means respond to instructions of at least one embroidering program stored in a control system which is integrated in or associated with the embroidery machine 5. In this manner, by combining the movements of the carriages on the plane X-Y based on the instructions of the embroidering program, the fabric 4 driven by the clamping frame 1 can be moved parallel to the plane X-Y in a plurality of directions so that the needle 53 can apply a sewing line on the fabric according to one or more predefined patterns defined in the embroidery program.

In the preferred embodiment, shown in the figures, the resting surface P can be a smooth sliding surface for the fabric 4, such that the fabric 4 remains integral by friction with the clamping frame 1 alone when said frame is in the lowered position on the surface P. Therefore, the pressure applied by the clamping frame 1 on the resting surface P is such as to allow in any case sliding of the fabric 4 on the surface P, but the fabric 4 remains retained in a direction at right angles to the surface P so as to not rotate and not slide with respect to the clamping frame 1.

In an alternative embodiment, not shown, the resting surface is a counterpressure surface which is connected to the clamping frame 1 so as to move integrally with such clamping frame 1 on an X-Y plane and on which the fabric 4 is fixed by friction by the clamping frame 1 when said frame is in the lowered position.

The template of the clamping frame 1 is composed essentially of a cutout plate 2 (i.e. a plate with one or more openings) and preferably also of a border 3 which is adapted to surround at least partially the cutout plate 2.

The cutout plate 2 preferably has a rectangular external shape and comprises one or more openings 21-22 having a shape that corresponds to a respective label to be applied by sewing to the fabric 4, so that said label can be retained laterally within the respective opening by form-fit coupling, particularly during the sewing of the label onto the fabric 4.

In particular, the inner rim 21*a* of at least one first opening 21 of the plate 2 is adapted to contain laterally a first respective label 20 during sewing (i.e. to surround the label 20 so as to prevent any lateral movement thereof within the opening 21), since the shape of said inner rim 21*a* is substantially equal to the shape of the perimetral rim 20*a* of the first label 20.

In the embodiment shown, the cutout plate 2 can also comprise a second opening 22, the inner rim 22*a* of which corresponds to that of another, respective label (not shown) having the same shape as the opening 22.

The border 3 is adapted to surround at least partially the cutout plate 2, so as to leave an interspace 23 between the inner rim 31 of the border 3 and the outer rim 25 of the cutout plate 2. Such rims 31 and 25 are preferably complementary in shape so as to obtain an interspace 23 of substantially constant width, for example a slit. The width of the interspace 23 around the cutout plate 2 is in any case such to allow at least one needle 53 of the embroidery machine 5 to pass in order to be able to sew the fabric 4 exposed along the interspace 23.

The border 3 can be, for example, a C-shaped plate, in which its inner rim 31 and, with it, the interspace 23 can be C-shaped with perpendicular and rectilinear sides, as in the embodiment shown in the drawings.

The inner rim 31 of the border 3 advantageously defines a lateral containment wall for the edge 30*a* of a corresponding second label 30 to be fixed to the fabric 4 by means of a corresponding perimetral sewing line 34, which is preferably closed.

According to an advantageous aspect of the invention, the cutout plate 2 and the border 3 can move with respect to each other in a transverse, preferably perpendicular, direction with respect to the resting surface P of the fabric 4, i.e., to the plane X-Y.

In particular, the cutout plate 2 and the border 3 are associated with a support which is fixed to the movement means 52 of the clamping frame 1.

The support comprises a first linear guide for a first slider 26 to which the cutout plate 2 is fixed by means, for example, of a bracket 27 which protrudes in a cantilever manner from the first slider 26. The first linear guide is directed transversely to the plane X-Y of movement of said support, i.e., to the resting surface P, and more preferably is perpendicular to the plane X-Y and/or to the surface P, as in the embodiment shown in the drawings, so as to guide the linear translation of the cutout plate 2 along said direction at right angles to the plane X-Y and/or the surface P.

The support can also comprise a second linear guide 56 for a second slider 36, said second guide 56 being parallel to the first guide. The border 3 is fixed to the second slider 36 by means, for example, of another bracket 37 which protrudes in a cantilever manner from the second slider 36. In this manner, the linear translation of the border 3 can be guided along a direction which is transverse, and more preferably at right angles, to the plane X-Y and/or the surface P.

The lifting mechanism can comprise a lever system (not shown) adapted to move selectively the sliders 26 and 36. Said lever system can have manual or automatic actuation.

The stored embroidering program of the embroidery machine 5 comprises the patterns of the sewing lines 24, 34 and instructions for moving the arm 52 so as to apply, in sequence, each sewing line 24, 34 in response to a respective start command of the user, which brings the clamping frame 1 to a known "zero" start position with respect to the sewing needle 53.

Since the correspondence between the pattern of the sewing line 24, 34 and the shape of the label to be applied 20, 30 is predefined and one-to-one, and likewise the shape of the openings 21-22 and of the interspace 23 is predefined, said "zero" positioning is programmed to bring under the needle 53 a region within the openings 21 or 22 or the interspace 23 and close to the rims 21*a* or 22*a* or 31, respectively, according to the respective pattern of the sewing line to be performed. The user shall arrange the label beforehand within the respective space (21, 22 or 23) of the template and start the corresponding embroidering program.

The operation of the invention is evident from the structural description given above.

In the illustrated embodiment, the method for sewing the labels 20 and 30 on the fabric 4 by means of the embroidery machine 5 entails raising initially the clamping frame 1 in order to allow the user to insert the fabric 4 between the frame 1 and the resting surface P.

The clamping frame 1 is then lowered onto the resting surface P in order to retain the fabric 4 in a direction at right angles to the resting surface P and integrally with said frame 1. In the case shown, said retention is obtained by friction between the frame 1 and the fabric 4, which renders the fabric 4 integral with the frame 1, allowing the sliding of the fabric 4 on the resting surface P when the frame 1 in the lowered position is moved along the resting surface P.

During the lowering of the clamping frame 1 onto the resting surface P, the cutout plate 2 and the border 3 can be lowered simultaneously. As an alternative, the border 3 can be lowered first as shown in FIG. 2, actuating therefore the lowering of the slider 36 alone, followed by the cutout plate 2.

This step can be repeated multiple times in order to allow the user to position the fabric in the best manner with respect to the sewing head 51 and to the region in which one wishes to apply the label.

The independent mobility of the cutout plate 2 and of the border 3 in the direction transverse to the plane X-Y and/or to the resting surface P is useful for loading into the template labels of different types that have a corresponding shape only in the inner rims of only one between the cutout plate 2 and the border 3.

Figure 2:
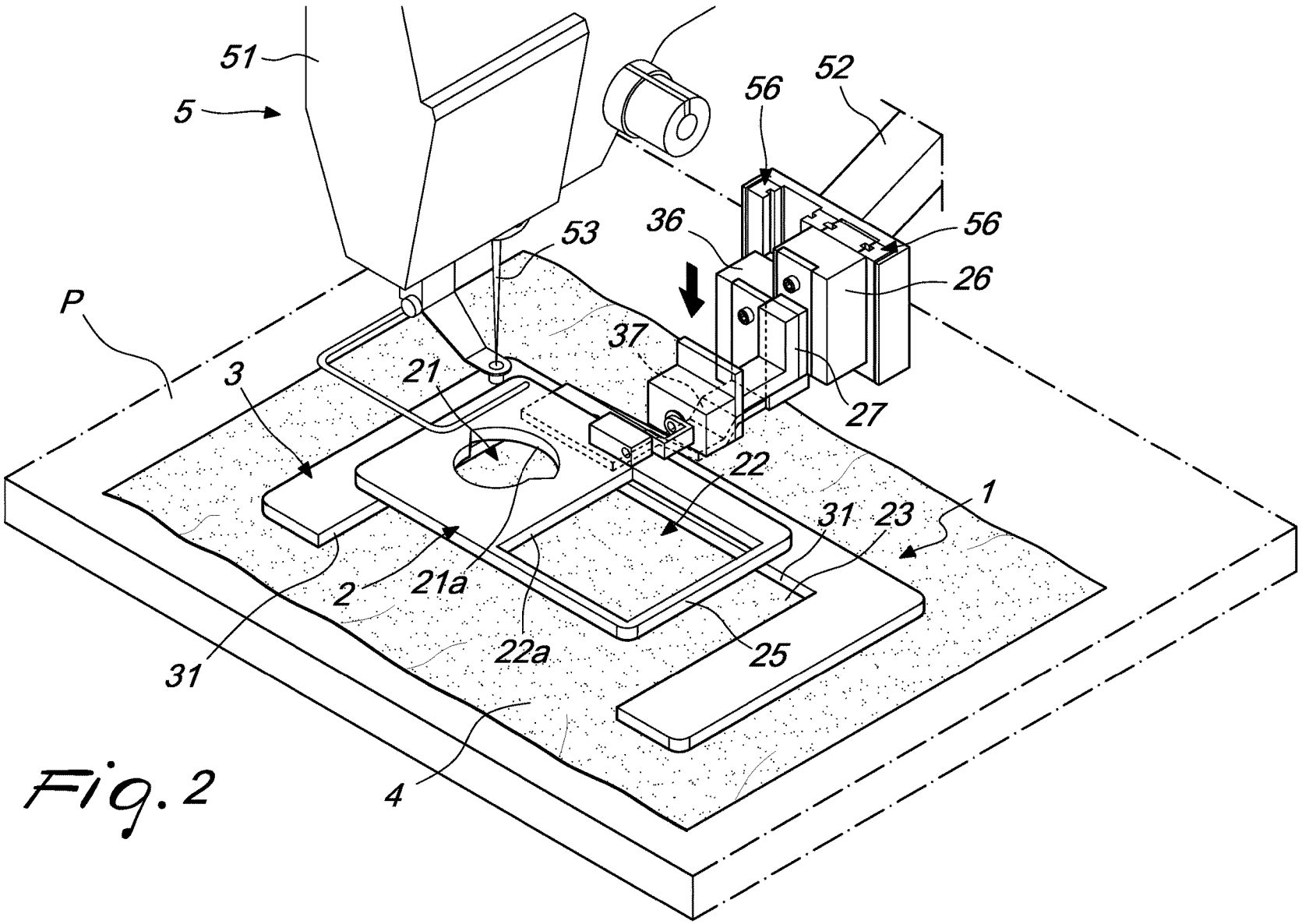
FIG. 2 is a view that corresponds to FIG. 1 but with a border of the clamping frame that is lowered with respect to a cutout plate of the same frame.
Figure 3:
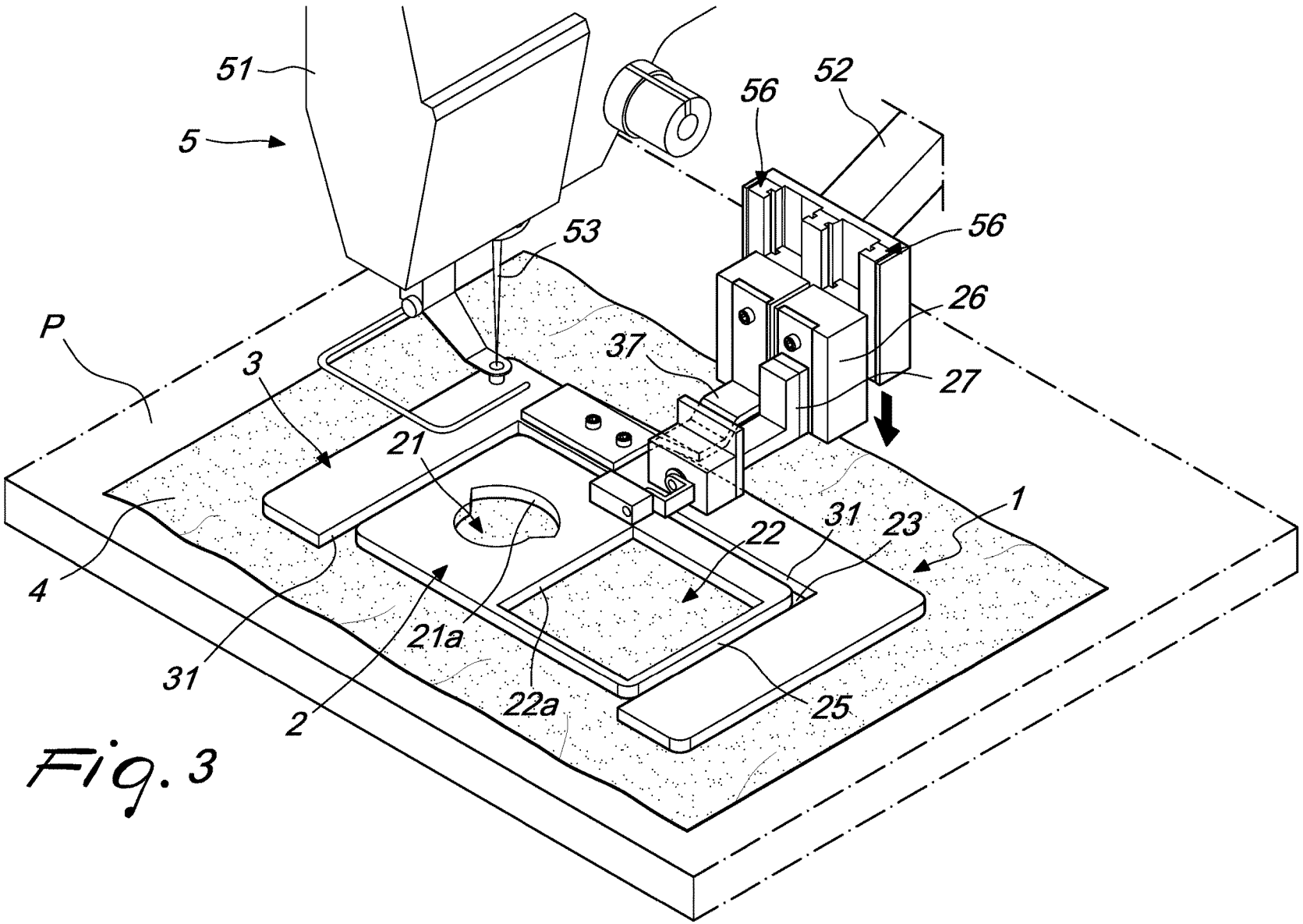
FIG. 3 is a view that corresponds to FIG. 1 but with the frame completely lowered in the position for clamping the fabric, i.e., for retaining the fabric in a direction at right angles to the resting surface of the fabric.

For example, by lowering the border 3 first, as shown in FIG. 2, it is possible to insert the second label 30, bringing it into abutment against the inner rim 31 of the border 3 and then starting the embroidering program in order to apply first the second sewing line 34.

Figure 4:
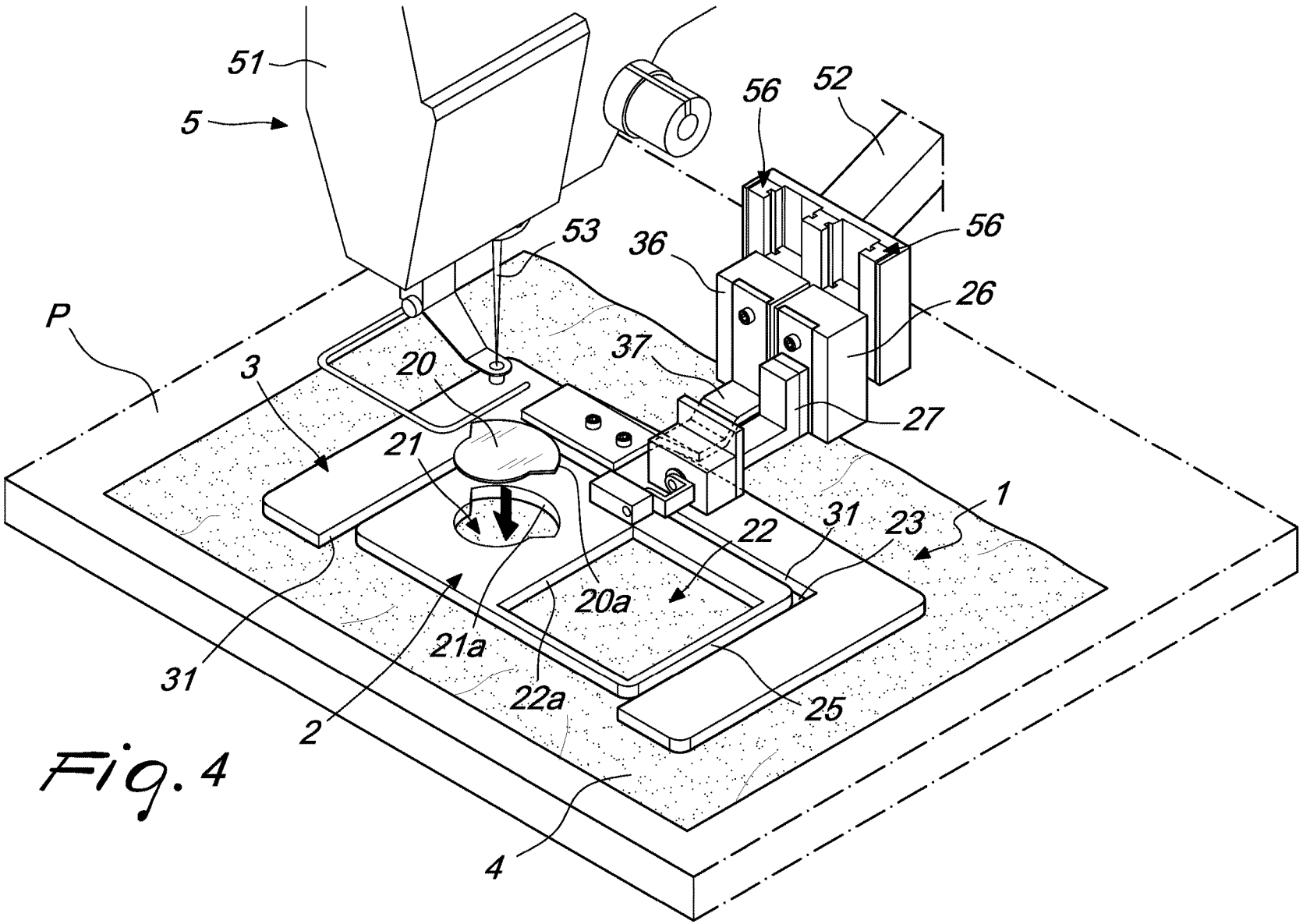
FIG. 4 is a view that corresponds to the preceding figure during the insertion of a first label in the cutout plate.
Figure 5:
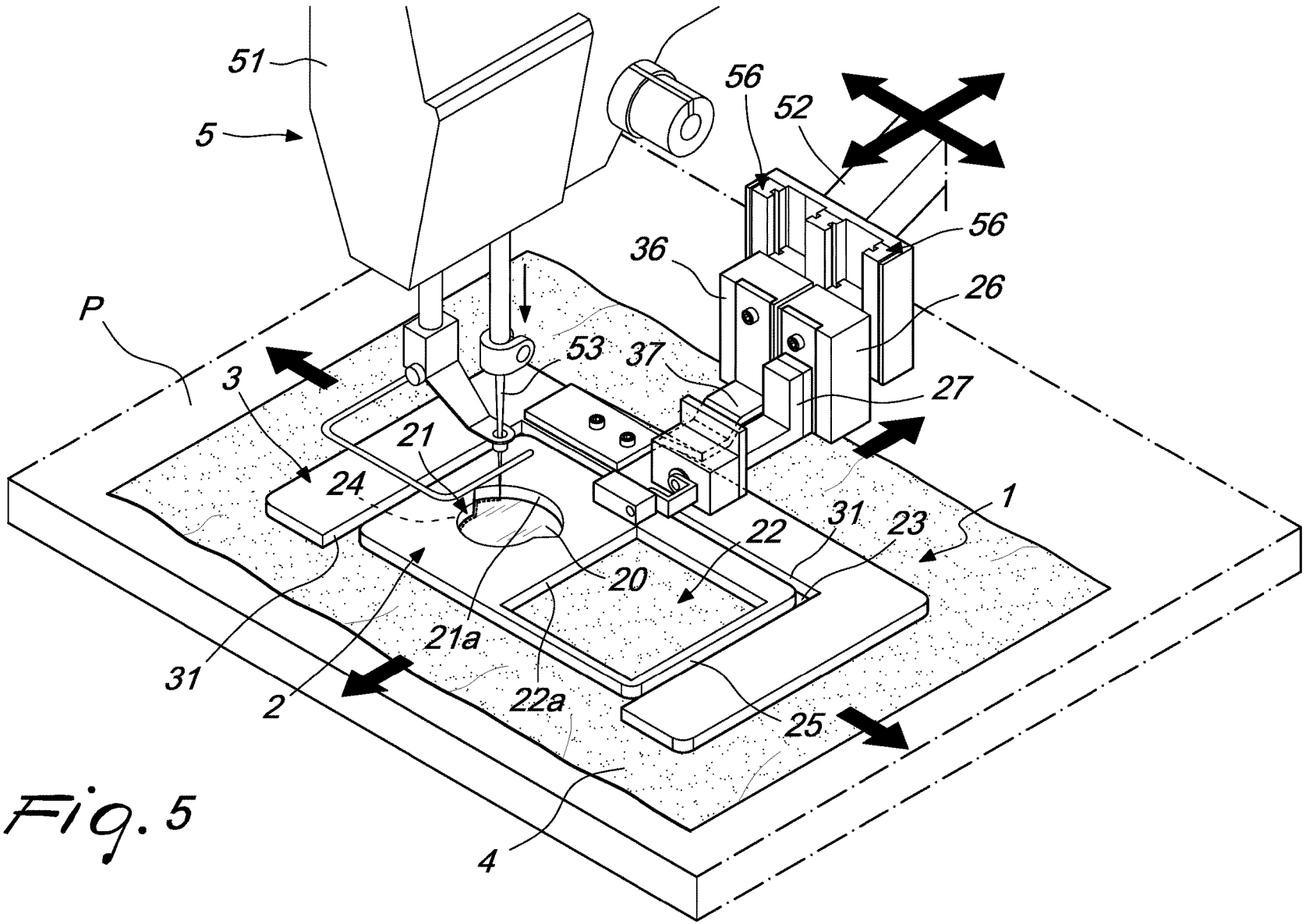
FIG. 5 is a view that corresponds to the preceding figure after the insertion of the first label and during the sewing thereof along its perimeter.
Figure 6:
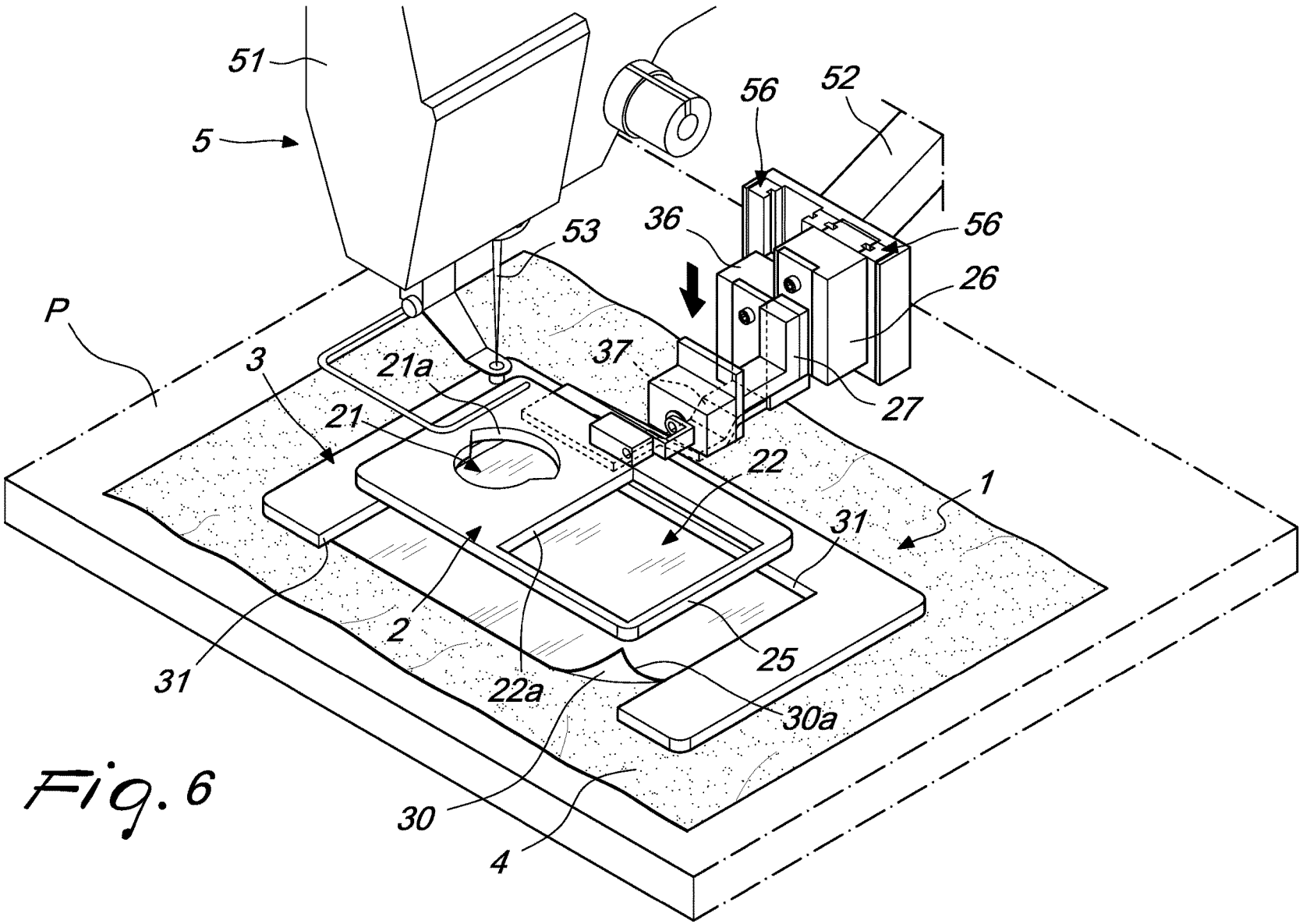
FIG. 6 is a view of the lifting of the cutout plate in order to insert a second label to be sewn onto the fabric.
Figure 7:
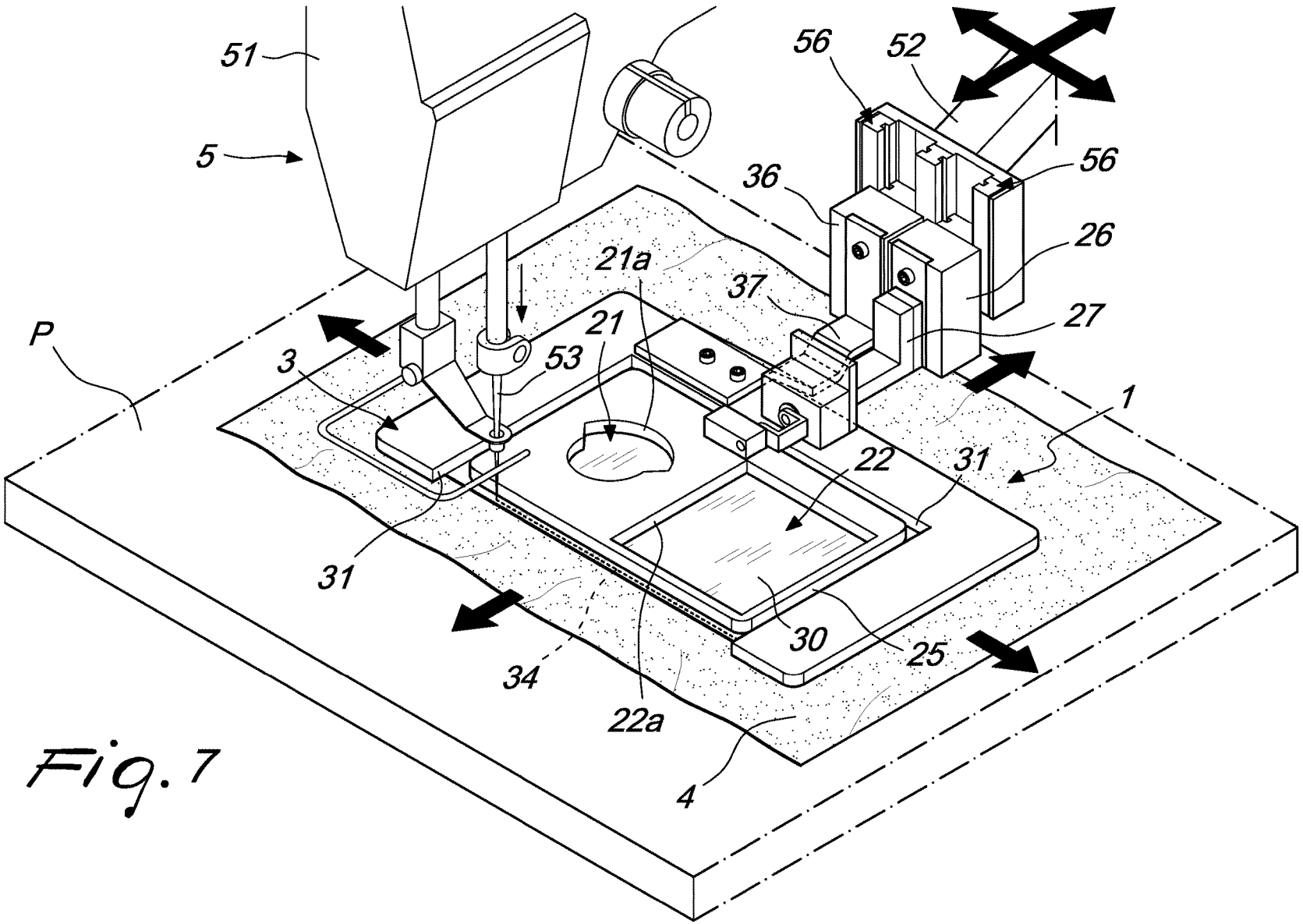
FIG. 7 is a view that corresponds to the preceding figure after the insertion of the second label and during the sewing thereof along its perimeter.

However, going back to the embodiment shown in the drawings, after the lowering of the cutout plate 2 as well, the user can insert the first label 20 into the corresponding first opening 21 of the cutout plate 2, making substantially the entire label 20 come in contact with the portion of the fabric 4 that is exposed in the opening 21 (FIG. 4). Since their perimetral shapes are identical, after said insertion the first label 20 results to be retained laterally by the inner rim 21*a* by a form-fit coupling, so as to not move along the fabric 4.

Optionally, based on the template and on the number of labels of different shape to be applied, the user can insert the label of the corresponding shape in the optional second opening 22.

At this point, the user starts the embroidering program to apply the first sewing line 24 along the peripheral region of the label 20 rested on the fabric 4 through the cutout plate 2. The sewing line 24 is preferably closed. The embroidery machine 5, by virtue of the movement means 52, brings the frame 1 to the zero position to sew the first line 24 and sewing is started, performed by the needle 53 and obtained by moving appropriately the fabric 4 and, integrally, the first label 20 by virtue of the movements of the frame 1 provided in the embroidering program.

Once the perimetral sewing of the first label 20 has been completed, the user lifts the clamping frame 1 in order to move the fabric 4 to another point on which to apply the second label 30, if any, or in order to insert a new fabric onto which to apply said second label 30. Then only the border 3 is lowered so that the border 3 retains the fabric in a direction at right angles to the resting surface and the second label 30 is inserted by the user, bringing it into abutment against the inner rim 31 of the border 3.

The cutout plate 2 can be subsequently lowered onto the fabric and the user starts the embroidering program of the second sewing line 34. The embroidery machine 5, by virtue of the movement means 52, brings the frame 1 to the zero position for sewing the second line 34 and sewing is started, performed by the needle 53 and obtained by moving conveniently the fabric 4 and, integrally, the second label 30 by virtue of the movements of the frame 1 provided in the embroidering program. In the embodiment shown, the predefined correspondence between the dimension of the template and the dimensions of the stored sewing line causes the needle to apply the second sewing line 34 along the entire interspace 23 between the border 3 and the cutout plate 2 and along the free rim of the cutout plate 2 that is not surrounded by the border 3.

In practice it has been found that the invention achieves the intended aim and objects.

The invention thus conceived is susceptible of numerous modifications and variations, all of which are within the scope of the inventive concept; all the details may furthermore be replaced with other technically equivalent elements.

In practice, the materials used so long as they are compatible with the specific use, as well as the contingent shapes and dimensions, may be any according to the requirements and the state of the art.

The invention claimed is:

1. A frame for clamping fabric for embroidery machines, comprising a template for sewing labels, said template being movable transversely with respect to a resting surface for a fabric and comprising at least one cutout plate, said cutout plate comprising at least one opening, said at least one opening being delimited by an inner rim adapted to contain laterally, by form-fit coupling, a first label during sewing, wherein said template further comprises a border adapted to surround at least partly said cutout plate, so as to leave an interspace between an inner rim of said border and an outer rim of said cutout plate, said inner rim of said border forming a lateral containment wall for a second label to be applied to the fabric, and wherein said cutout plate and said border are associated with a support which can be fixed to means for moving the clamping frame of an embroidery machine, said support comprising a first slider to which said cutout plate is fixed and a second slider to which said border is fixed, said first and second sliders being able to slide along said support in substantially mutually parallel directions and transversely to the resting surface for the fabric.

2. The clamping frame according to claim 1, wherein said cutout plate and said border can move with respect to each other transversely to the resting surface for the fabric.

3. An embroidery machine comprising a sewing head and a resting surface for a fabric, wherein the embroidery machine comprises a frame for clamping the fabric, said clamping frame comprising a template for sewing labels, said template being movable transversely with respect to the resting surface for the fabric and comprising at least one cutout plate, said cutout plate comprising at least one opening, said at least one opening being delimited by an inner rim adapted to contain laterally, by form-fit coupling, a first label during sewing, wherein said template further comprises a border adapted to surround at least partly said cutout plate, so as to leave an interspace between an inner rim of said border and an outer rim of said cutout plate, said inner rim of said border forming a lateral containment wall for a second label to be applied to the fabric, and wherein said cutout plate and said border are associated with a support which can be fixed to means for moving the clamping frame of the embroidery machine, said support comprising a first slider to which said cutout plate is fixed and a second slider to which said border is fixed, said first and second sliders being able to slide along said support in substantially mutually parallel directions and transversely to the resting surface for the fabric.

4. The embroidery machine according to claim 3, wherein said clamping frame can move automatically with respect to the sewing head according to a stored embroidery program, said embroidery program comprising instructions for the application of at least one first sewing line along a peripheral region of the first label, said clamping frame being adapted to retain said fabric at right angles to the resting surface for the fabric and simultaneously to move said fabric with respect to said sewing head along said resting surface according to the instructions of said embroidery program, said clamping frame being adapted for the lateral containment of the first label within said at least one opening of the cutout plate during the application of said at least one first sewing line along a peripheral region of said first label.

5. The embroidery machine according to claim 4, wherein said embroidery program furthermore comprises instructions for the application of a second sewing line along a peripheral region of the second label and along said interspace between the border and the cutout plate, said clamping frame being adapted for the lateral containment of the second label within the inner rim of said border during the application of said second sewing line along a peripheral region of said second label and along said interspace between the border and the cutout plate.

6. A method for sewing labels on a fabric using an embroidery machine, the embroidery machine comprising a sewing head, a resting surface for the fabric, and a clamping frame for clamping the fabric, said clamping frame comprising a cutout plate having at least one opening delimited by an inner rim and a border adapted to at least partly surround said cutout plate so as to leave an interspace between an inner rim of said border and an outer rim of said cutout plate, said cutout plate and said border being associated with a support which can be fixed to means for moving said clamping frame, said support comprising a first slider to which said cutout plate is fixed and a second slider to which said border is fixed, said first and second sliders being able to slide along said support in substantially mutually parallel directions and transversely to the resting surface for the fabric, wherein the method, comprises:

lifting the clamping frame in order to interpose the fabric between said clamping frame and the resting surface;

lowering the clamping frame onto the resting surface in order to retain the fabric in a direction at right angles to the resting surface;

inserting a first label in said at least one opening of the cutout plate of the clamping frame, so that a form-fit coupling occurs between said first label and said opening;

applying at least one first sewing line along a peripheral region of said first label by means of the actuation of at least one needle of the sewing head and of the simultaneous movement of said clamping frame with respect to said sewing head according to an embroidery program.

7. The method according to claim 6, further comprising, before or after the step of insertion of said first label:

lifting the cutout plate with respect to said border;

inserting a second label within the inner rim of said border;

lowering the cutout plate onto said fabric;

applying a second sewing line along a peripheral region of said second label and along said interspace between said border and said cutout plate.

8. The method according to claim 7, further comprising, before the insertion of the second label, lifting and subsequently lowering said border so that said border retains the fabric in a direction at right angles to the resting surface.

* * * * *